US011528931B2

(12) United States Patent
Sanna et al.

(10) Patent No.: US 11,528,931 B2
(45) Date of Patent: Dec. 20, 2022

(54) METHOD AND APPARATUS FOR THE PRODUCTION OF A COMPONENT OF AN AEROSOL GENERATING ARTICLE

(71) Applicant: PHILIP MORRIS PRODUCTS S.A., Neuchatel (CH)

(72) Inventors: Daniele Sanna, Marin-Epagnier (CH); Johann Schmidt, Mindelau (DE)

(73) Assignee: Philip Morris Products S.A., Neuchatel (CH)

( * ) Notice: Subject to any disclaimer, the term of this patent is extended or adjusted under 35 U.S.C. 154(b) by 595 days.

(21) Appl. No.: 16/471,036

(22) PCT Filed: Dec. 28, 2017

(86) PCT No.: PCT/EP2017/084730
§ 371 (c)(1),
(2) Date: Jun. 19, 2019

(87) PCT Pub. No.: WO2018/122320
PCT Pub. Date: Jul. 5, 2018

(65) Prior Publication Data

US 2020/0114097 A1 Apr. 16, 2020

(30) Foreign Application Priority Data

Dec. 29, 2016 (EP) ..... 16207402

(51) Int. Cl.
*A24C 5/18* (2006.01)
*A24B 3/14* (2006.01)
(Continued)

(52) U.S. Cl.
CPC ..... *A24B 3/14* (2013.01); *A24C 5/01* (2020.01); *A24C 5/18* (2013.01); *A24C 5/1828* (2013.01);
(Continued)

(58) Field of Classification Search
CPC ..... A24B 3/14; A24B 15/167; A24C 5/01; A24C 5/18; A24C 5/1828; A24C 5/28; A24C 5/1821; A24D 1/20
See application file for complete search history.

(56) References Cited

U.S. PATENT DOCUMENTS 5,348,027 A * 9/1994 Barnes ..... A24D 1/22 131/194
8,215,315 B2 8/2012 Atwell
(Continued)

FOREIGN PATENT DOCUMENTS

CN 101883502 11/2010
EP 2967156 1/2016
(Continued)

OTHER PUBLICATIONS

Office Action issued in Europe for Application No. 201780068893.5 dated Mar. 31, 2021 (20 pages).
(Continued)

*Primary Examiner* — Eric Yaary
(74) *Attorney, Agent, or Firm* — Mueting Raasch Group

(57) ABSTRACT

The invention relates to an apparatus (1) for the production of a rod component (100) of an aerosol generating article, said apparatus comprising: ° a first mover (4) adapted to transport a first sheet (2) along a first direction; ° a second mover (5) adapted to transport a second sheet (3) along a second direction; ° a third mover (6) adapted to transport a susceptor strip (10) along a third direction, said third mover being adapted to position said susceptor strip between the first and the second sheet during transport; and a rod forming device (20) being adapted to form a rod from the first and the second sheets and the susceptor strip and having an inlet (21)
(Continued)

and an outlet (22), wherein said first and second sheets and said susceptor strip are introduced in said inlet and said rod is outputted from said outlet.

8 Claims, 4 Drawing Sheets

(51) Int. Cl.

| | |
|---|---|
| ***A24C 5/01*** | (2020.01) |
| ***A24D 1/20*** | (2020.01) |
| ***A24C 5/28*** | (2006.01) |
| *A24B 15/167* | (2020.01) |

(52) U.S. Cl.
CPC ..... *A24C 5/28* (2013.01); *A24D 1/20* (2020.01); *A24B 15/167* (2016.11)

(56) References Cited

U.S. PATENT DOCUMENTS

| | | | | |
|---|---|---|---|---|
| 10,499,685 | B2 * | 12/2019 | Prestia | A24D 1/20 |
| 2007/0068540 | A1 * | 3/2007 | Thomas | B31F 1/0051 131/88 |
| 2015/0181938 | A1 | 7/2015 | Metrangolo | |
| 2016/0295921 | A1 | 10/2016 | Mironov | |

FOREIGN PATENT DOCUMENTS

| | | |
|---|---|---|
| WO | WO 2016/184928 | 11/2016 |
| WO | WO 2016/184929 | 11/2016 |

OTHER PUBLICATIONS

PCT Search Report and Written Opinion for PCT/EP2017/084730 dated Apr. 5, 2018 (14 pages).

* cited by examiner

METHOD AND APPARATUS FOR THE PRODUCTION OF A COMPONENT OF AN AEROSOL GENERATING ARTICLE

This application is a U.S. National Stage Application of International Application No. PCT/EP2017/084730 filed Dec. 28, 2017, which was published in English on Jul. 5, 2018, as International Publication No. WO 2018/122320 A1. International Application No. PCT/EP2017/084730 claims priority to European Application No. 16207402.5 filed Dec. 29, 2016.

The present specification relates to a method and an apparatus for the production of a component of an aerosol-generating article, for example of the type comprising an aerosol-forming substrate for generating an inhalable aerosol when heated.

The aerosol-generating articles may comprise an elongate susceptor in thermal contact with the aerosol-forming substrate, such that heating of the aerosol-forming substrate may be effected by induction-heating. A number of aerosol-generating articles, or smoking articles, in which tobacco is heated rather than combusted have been proposed in the art. One aim of such heated aerosol-generating articles is to reduce known harmful smoke constituents of the type produced by the combustion and pyrolytic degradation of tobacco in conventional cigarettes.

Typically in such heated aerosol-generating articles, an aerosol is generated by the transfer of heat from a heat source to a physically separate aerosol-forming substrate or material. During smoking, volatile compounds are released from the aerosol-forming substrate by heat transfer from the heat source and entrained in air drawn through the aerosol-generating article. As the released compounds cool, they condense to form an aerosol that is inhaled by the user.

In WO 2015/176898, an aerosol-generating article is described, which comprises a plurality of elements assembled in the form of a rod having a mouth end and a distal end upstream from the mouth end. The plurality of elements include an aerosol-forming substrate located at or towards the distal end of the rod. An elongate susceptor is arranged substantially longitudinally within the rod and in thermal contact with the aerosol-forming substrate. The susceptor allows the article to be consumed using an electrically-operated aerosol-generating device having an inductor.

For smoking such an article, an inductive heating device comprises an induction source which produces an alternating electromagnetic field which induces heat generating eddy currents and hysteresis losses in a susceptor. The susceptor is in thermal proximity of the aerosol-forming substrate, for example a tobacco substrate. The heated susceptor in turn heats the aerosol-forming substrate which comprises a material which is capable of releasing volatile compounds that can form an aerosol.

One problem of these aerosol-generating articles regards the position of susceptor which is inserted in the aerosol-forming substrate: it is difficult to have a similar amount of aerosol-forming substrate material on each side of the susceptor consistently. Obtaining an equal amount of aerosol-forming substrate on both part of the susceptor is important because an uneven distribution of susceptor may lead to smoking experiences that could change from one heatable product to another.

It would be desirable to have an efficient method and apparatus for manufacturing inductively heatable aerosol-forming tobacco components, for example those suitable for use in inductive heating devices, which prevent or minimize such flaw.

According to a first aspect, the invention relates to an apparatus for the production of a rod component of an aerosol generating article, said apparatus comprising: a first mover adapted to transport a first sheet along a first direction; a second mover adapted to transport a second sheet along a second direction; a third mover adapted to transport a susceptor strip along a third direction, said third mover being adapted to position said susceptor strip between the first and the second sheet during transport; and a rod forming device being adapted to form a rod from the first and the second sheets and the susceptor strip and having an inlet and an outlet, wherein said first and second sheets and said susceptor strip are introduced in said inlet and said rod is outputted from said outlet.

The apparatus of the invention first produces a multi-layered element having a susceptor strip sandwiched between two sheets. This ensemble is then compressed into a rod by a rod forming device so that—when the rod is produced—the susceptor is already trapped between two sheets of the desired material, for example tobacco containing sheets. In this way, the movements of the susceptor are limited and a substantially equal amount of sheet is already positioned on opposite sides of the susceptor. An even surrounding of the susceptor can be then achieved due to the initial sandwiched configuration on both sides of the susceptor.

Preferably, the first or the second sheet is a tobacco containing sheet and more preferably it is a sheet of homogenized tobacco material. The first and the second sheet may have a different composition.

The homogenized sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition is then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web, for example by casting a viscous slurry onto a moving metal belt to produce so called cast leaf.

The homogenized tobacco material may also comprise an aerosol-former. As used herein, the term 'aerosol former' is used to describe any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferred aerosol formers are polyhydric alcohols or mixtures thereof, such as propylene glycol, triethylene glycol, 1,3-butanediol and, most preferred, glycerine.

Preferably, the homogenized tobacco sheet has an aerosol former content of greater than 5% on a dry weight basis. The homogenzied tobacco sheet may have an aerosol former content of between approximately 5% and approximately 30% on a dry weight basis.

In a preferred embodiment, the homogenized tobacco sheet has an aerosol former content of approximately 20% on a dry weight basis.

The sheet of homogenized tobacco material is preferably then rolled in bobbins which needs to be unwound in order to be further processed, to be part for example of an aerosol-forming article, that is to be included in the aerosol-forming substrate of the aerosol-forming article. In a "heat-not-burn" aerosol-generating article, an aerosol-forming substrate is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol-generating article. This means that the aerosol composition that is generated by such a "heat-not-burn" aerosol-generating article is substantially only based on the homogenized tobacco material.

As used herein, the term "aerosol-forming substrate" is used to describe a substrate capable of releasing, upon heating, volatile compounds, which can form an aerosol. The aerosol generated from aerosol-forming substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

Preferably, the aerosol-generating article is a smoking article that generates an aerosol that is directly inhalable into a user's lungs through the user's mouth. More, preferably, the aerosol-generating article is a smoking article that generates a nicotine-containing aerosol that is directly inhalable into a user's lungs through the user's mouth.

The aerosol-forming substrate may comprise a non-tobacco containing aerosol-forming material. For example, the aerosol-forming material may be a sheet comprising a nicotine salt and an aerosol former.

If the aerosol-forming substrate is a solid aerosol-forming substrate, the solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

Optionally, the solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

As used herein, the term "sheet" denotes a laminar element having a width and length substantially greater than the thickness thereof.

As used herein, the term "aerosol-generating device" is used to describe a device that interacts with an aerosol-forming substrate of an aerosol-generating article to generate an aerosol. Preferably, the aerosol-generating device is a smoking device that interacts with an aerosol-forming substrate of an aerosol-generating article to generate an aerosol that is directly inhalable into a user's lungs thorough the user's mouth. The aerosol-generating device may be a holder for a smoking article.

As used herein, the term "susceptor" refers to a material that can convert electromagnetic energy into heat. When located within a fluctuating electromagnetic field, eddy currents induced in the susceptor cause heating of the susceptor. As the elongate susceptor is located in thermal contact with the aerosol-forming substrate, the aerosol-forming substrate is heated by the susceptor.

The aerosol-generating article is designed to engage with an electrically-operated aerosol-generating device comprising an induction heating source. The induction heating source, or inductor, generates the fluctuating electromagnetic field for heating a susceptor located within the fluctuating electromagnetic field. In use, the aerosol-generating article engages with the aerosol-generating device such that the susceptor is located within the fluctuating electromagnetic field generated by the inductor.

The susceptor may be formed from any material that can be inductively heated to a temperature sufficient to generate an aerosol from the aerosol-forming substrate. Preferred susceptors comprise a metal or carbon. A preferred susceptor may comprise a ferromagnetic material, for example ferritic iron, or a ferromagnetic steel or stainless steel. A suitable susceptor may be, or comprise, aluminium. Preferred susceptors may be formed from 400 series stainless steels, for example grade 410, or grade 420, or grade 430 stainless steel. Different materials will dissipate different amounts of energy when positioned within electromagnetic fields having similar values of frequency and field strength. Thus, parameters of the susceptor such as material type, length, width, and thickness may all be altered to provide a desired power dissipation within a known electromagnetic field.

Preferred susceptors may be heated to a temperature in excess of 250 degrees Centigrade. Suitable susceptors may comprise a non-metallic core with a metal layer disposed on the non-metallic core, for example metallic tracks formed on a surface of a ceramic core.

A susceptor may have a protective external layer, for example a protective ceramic layer or protective glass layer encapsulating the elongate susceptor. The susceptor may comprise a protective coating formed by a glass, a ceramic, or an inert metal, formed over a core of susceptor material.

The invention refers to an apparatus and a method to produce a rod component for an aerosol generating article.

The component obtained using the apparatus or method of the invention is preferably used in an aerosol-generating article which preferably interacts with an aerosol generating device. Preferably, the component is—or comprises—an inductively heatable tobacco segment.

The inductively heatable tobacco segment comprises aerosol-forming tobacco substrate and a susceptor element. In general, an inductively heatable smoking article is introduced into a cavity of the inductive heating device such that heat may be induced in the susceptor element of the tobacco segment by a corresponding inductor of a power supply electronics arranged in the inductive heating device.

In order to form the component for the aerosol generating article where the susceptor is substantially evenly surrounded by the aerosol forming substrate, preferably two sheets, such as two sheets of aerosol forming substrate, are provided and transported along a first and a second direction, respectively, by a first and a second mover. A susceptor strip is also provided and transported along a third direction. A third mover transporting the susceptor strip is located so that the susceptor strip travels between the first and the second sheet. The third mover is so positioned and configured to keep the susceptor strip between the two sheets preferably made of aerosol forming material.

The rod forming device compresses the two sheets and the susceptor strip in order to form a rod. In the rod forming device, the susceptor strip reaches thermal contact with the sheets. Thus, preferably, when the susceptor strip heats up in the aerosol forming device, the aerosol-forming substrate (the sheets) is heated up and an aerosol is formed. Preferably the susceptor strip is arranged in direct physical contact with the sheets, without any additional element in between.

Although the term "strip" has been used, the susceptor strip can have any type of elongated form, such as the form of an elongated rod, elongated blade, elongated pin, etc.

Due to the construction of the rod forming device and due to the fact that preferably the susceptor strip has been located symmetrically between the two sheets, the final configuration of the resulting rod is also preferably symmetrical, and the susceptor strip is arranged substantially longitudinally within the rod. This means that the length dimension of the susceptor strip is preferably arranged to be approximately parallel to the longitudinal direction of the rod, for example the susceptor strip may form an angle of about plus or minus 10 degrees with the longitudinal direction of the rod. In preferred embodiments, the elongate susceptor element may be positioned in a radially central position within the rod, and extends along the longitudinal axis of the rod.

Thanks to the apparatus of the invention, the susceptor strip is preferably in a central position inside the rod, with a similar amount of sheets, such as tobacco substrate, on each side, providing though consistent smoking experience and decreasing chances of obtaining components outside the specifications, such as components in which the susceptor strip touches or burns an outside wrapping material, or burns the user finger touching the rod.

Further, the position of the susceptor strip is strongly hold by the sheets which become wrapped around the susceptor, decreasing the chance that the susceptor may move within the rod during rod-forming.

Due to the advantages referred above, production consistency is strongly improved according to related specifications, resulting into a more consistent product, and therefore improving repeatability of product consumption as "smoking" experience, as well as for example in terms of nicotine deliveries and overall sensorial experience of the users.

Preferably, the apparatus includes a crimper positioned upstream of the rod forming device in the first or second direction of transport of the first or second sheet to crimp the first or the second sheet. Preferably, both sheets are crimped before entering the rod forming device.

As used herein, the term "crimped sheet" denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled. A crimped sheet further better folds around the susceptor strip.

Preferably, the apparatus includes a U shaped conveyor adapted to transport the rod exiting the outlet of the rod forming device. The conveyor belt may also include a wrapping paper to wrap the rod. Further, the U shaped conveyor keeps the rod shaped form of the component.

Preferably, the apparatus includes a wrapper unit to wrap the rod. The wrapper unit may wrap the rod in a proper wrapping sheet for an aerosol generating article.

Preferably, said susceptor strip defines a first and a second opposed surfaces and said first, second and third mover are so arranged to transport the first and second sheet and the susceptor strip, respectively, with the susceptor strip between the first and second sheet so that the first surface faces the first sheet and the second surface faces the second sheet. More preferably, said third mover is so arranged that it positions said first and second surface substantially horizontally or substantially vertically. The susceptor strip first and second surface may substantially define a plane, and the first and the second sheet in the rod forming unit align to this plane, so that the susceptor first and second surfaces are caught in between the two sheets in the rod forming device, and thus held in a central position. This central position may be a horizontal position if the strip of susceptor, such as its two opposite surfaces, is substantially horizontal, that is the first or second surface defines a plane parallel to a horizontal plane. Having the first and second surfaces of the susceptor strip substantially horizontal makes it easier to cut the resulting rod exiting the rod forming device using vertically moving knifes or blades that are used on usual smoking article production lines. Alternatively, the susceptor first and second surfaces may run perpendicular to the horizontal plane, thanks to the action of the first and second mover. In this configuration, the first and second surfaces are thus substantially vertical. Such embodiment may assure that, when the rod arrives in the U shaped conveyor belt, due to the consequent vertical position of the susceptor in the rod, the same friction strength is applied to both first and second sheet as both sheets are in contact with the same surface of the conveyor belt or with a wrapping material positioned onto the conveyor belt, preventing one sheet to become different from the other due to friction application.

Preferably, the apparatus includes cutting means to cut the rod exiting the outlet of the rod forming device into rod components of the aerosol forming article. The rod exiting the rod forming device is a continuous elongated element which is preferably cut in shorter pieces which are the components to be used in the aerosol generating article.

Preferably, the apparatus includes a cutting device to cut the susceptor strip in susceptor segments, the cutting device being located upstream of the rod forming device. The susceptor segments are then introduced and sandwiched between the first and second sheet, preferably positioned at regular intervals, having the same distance one from the other. Preferably, the susceptor segments are inserted between the two sheets in series, that is, one susceptor element follows the previous susceptor element along the third direction. Preferably, the susceptor segment has as its maximum length the same length of the component to be used in the aerosol-generating article, and more preferably the susceptor segment is shorter than the component. Preferably, the components have all the same length. Preferably, the susceptor segments have also all the same length. Preferably, the susceptor segment has a length dimension that is greater than its width dimension or its thickness dimension, for example greater than twice its width dimension or its thickness dimension. Preferably, the susceptor segment has a length of between about 2 millimeter and about 20 millimeter, more preferably it has a length of between about 5 millimetres and about 15 millimetres, for example between about 6 millimetres and about 12 millimetres, or between about 8 millimetres and about 10 millimetres. The susceptor segment or the susceptor strip preferably has a width of between about 1 millimetre and about 5 millimetres and may have a thickness of between about 0.01 millimetres and about 2 millimetres, for example between about 0.5 millimetres and about 2 millimetres. A preferred embodiment may have a thickness of between about 10 micrometres and about 500 micrometres, or even more preferably between about 10 micrometres and about 100 micrometres. If the susceptor strip or segment has a constant cross-section, for example a circular cross-section, it has a preferable width or diameter of between about 1 millimetre and about 5 millimetres.

More preferably, the third mover includes a plurality of handler, each handler being adapted to transport a susceptor segment towards the rod forming device. Even more preferably, the handler includes a magnetic element to hold the susceptor segment onto the handler. Using magnetic strength with handlers could be advantageous as it will allow to pick up and insert in the rod forming device only the susceptor segments that are ferromagnetic, which could be a preferred prerequisite for the susceptor segments. Susceptor segments not having this characteristic are preferably disregarded. Alternatively, instead of or in addition to a magnetic force, suction, such as air suction, might be used as well. At the insertion position of the rod forming device, suction or magnetic strength may be interrupted such that the susceptor segments may be positioned in between the partially gathered sheets.

Preferably, the apparatus includes a converging device for each sheet positioned upstream the rod forming device. Each of the two sheets is preferably first guided through a separate converging device before entering the rod forming device, where the main converging or gathering takes place, so as to help the sheet to reach a rod shape in the rod forming device and to be positioned correctly on each side of the susceptor strip.

In a second aspect, the invention relates to a method for the production of a component of an aerosol generating article, said method including: providing a first sheet; providing a second sheet; providing a strip of susceptor; transporting the first and second sheets and the strip of susceptor along a first, second and third direction, respectively, keeping the strip of susceptor located between the first and the second sheets during the transport; and forming a rod gathering together the first and the second sheets and the strip of susceptor located therebetween.

Advantages of the method of the invention have been already outlined with reference to the first aspect and therefore not repeated herewith.

Preferably, providing a first and a second sheet includes providing a first and a second sheet having substantially the same thickness. In this way, an even distribution of the sheets around the susceptor strip is obtained, aiming at a substantially constant amount of material around the susceptor in the final component for the aerosol-generating article.

Preferably, providing a strip of susceptor includes providing a strip of susceptor in metal or carbon material. The material in which the susceptor is made preferably is adapted to the required heating.

Preferably, providing a strip of susceptor includes providing a strip of susceptor having a thickness comprised between about 0.2 millimetres and about 2 millimetres or a strip of susceptor having a width comprised between about 1 millimetres and about 5 millimetres.

Preferably, the step of moving the first, second sheet and the susceptor along a first, second and third direction includes moving the first, second sheet and the strip of susceptor so that the first, second and third direction are coplanar. In this way, a better gathering of the sheets and strip is obtained, staring already from a substantially symmetrical configuration, so that also a symmetrical final configuration in the rod may be obtained, with the susceptor strip evenly surrounded by the sheets in the rod.

Preferably, the method includes coating the first or second sheet or the strip of susceptor with a water based solution. The susceptor is preferably coated with a water based solution, for example with a tobacco slurry used to form the sheets, so as to prevent the susceptor to burn the wrapping material wrapped around the rod when the induction is activated in the final product. Such coating would preferably have a thickness of between about 2 micrometers and about 5 micrometers.

Preferably, the step of providing a strip of susceptor includes: providing a continuous strip of susceptor; cutting the continuous strip of susceptor in susceptor segments; and transporting the susceptor segments between the first and second sheet. The individual susceptors for each individual component of the aerosol forming article are thus formed before the rod forming device. Preferably, in a component a single susceptor segment is located, however the location of more than a susceptor segment in a single component is envisaged as well.

More preferably, transporting the susceptor segments between the first and second sheet includes attaching the susceptor segments onto a third sheet prior of forming the rod. A way to transport the susceptor segments into the rod forming device is for example to attach the segments to a third sheet which is then transported between the first and the second sheet into the rod forming unit. Such a sheet can be for example realized in the same material as the first and second sheets, for example a homogenized tobacco material to be used as an aerosol forming substrate.

More preferably, the method includes coating the third sheet or the susceptor segments with a water based solution. Susceptor segments are laid on a tabocco reconstituted strip, with water to provide stickiness, to enhance insertion, and suceptor can be sandwiched between two tabocco reconstituted strips, with water to provide stickiness, to enhance insertion and avoid risk of direct contact with the wraper.

Preferably, the component of the aerosol generating article has a pre-determined length, and the step of cutting the continuous strip of susceptor in susceptor segments includes cutting the continuous strip of susceptor in susceptor segments having a length equal to or smaller than the pre-determined length of the component. In order to form components, the rod exiting the rod forming device is preferably cut into pieces having a given length. In order to obtain components each including correctly a portion of the susceptor, preferably the selected length of the component is longer than the length of the susceptor segment so that each component contains one, or an integer multiple of, susceptor segments.

Preferably, the step of cutting the continuous strip of susceptor in susceptor segments includes cutting the continuous strip of susceptor in susceptor segments having a length comprised between about 2 millimetres and about 20 millimetres. This is a size which may fit most of the components for aerosol generating article.

Preferably, the step of cutting the continuous strip of susceptor in susceptor segments includes cutting the continuous strip of susceptor in susceptor segments having a length longer than twice its width or its thickness. The susceptor segments are therefore preferably "elongated" objects.

Preferably, the method includes cutting the rod into components of the aerosol forming article. The cutting of the rod takes place preferably downstream of the rod forming device, even more preferably after the step of wrapping the rod.

More preferably, the method includes synchronizing the cutting of the rod into components with a speed of the transport of the first, or of the second sheet or of the strip of susceptor along the first, second or third direction, respectively. In an embodiment with susceptor segments, in the afterwards process, the continuous inductively heatable tobacco rods coming out of the rod forming device is cut at positions between subsequent susceptor segments in the tobacco rod. In this way, a proper and correct cutting of the components at the desired length takes place. In case susceptor segments are present, the synchronization is such that the cutting of the rod to form components takes place on that portion of the rod located in between two adjacent susceptor segments. That is, the cut in the rod is made between two consecutive susceptor segments, and therefore the cutting has to be synchronized with the void location between one susceptor segment and the following one. This is preferably done by synchronizing the cutting of the tobacco rod with a moving speed of the sheets and susceptor strip. Another way to do so is to use a device sensing the susceptor segments in the rod and synchronizing accordingly a knife or blade to cut the rod between two adjacent susceptor segments.

Preferably, the method comprises sensing the presence of a susceptor segment in the rod before cutting the rod. In this way, the resulting component may encapsulate the susceptor segment completely.

Preferably, the method includes wrapping the components in a wrapping sheet.

Preferably, the method includes the step of transporting the first and the second sheet at the same transport speed. A symmetric rod is in this way more easily obtained.

The invention further relate to an aerosol-generating article including a component realized according to the second aspect of the invention.

The invention will be further described, by way of example only, with reference to the accompanying drawings in which.

In FIGS. 1-6, an apparatus for the production of a rod component is shown and indicated with the reference number 1.

Figure 1:
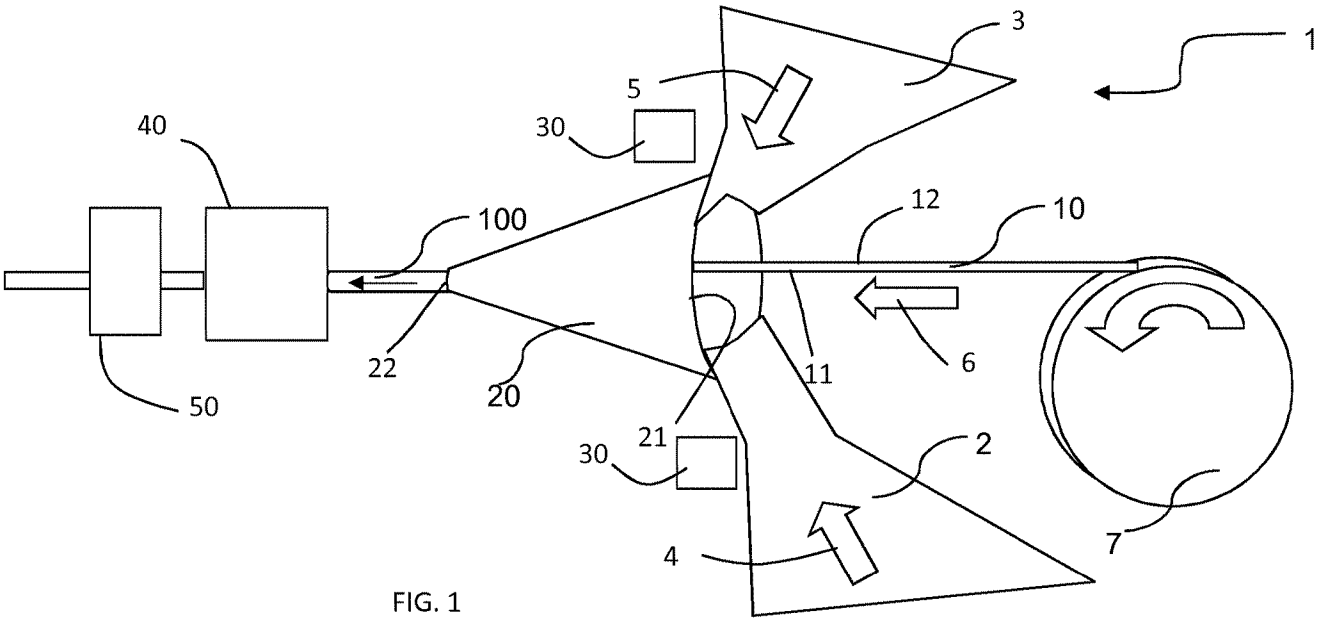
FIG. 1 is a schematic perspective view of a first embodiment of an apparatus operating according to the present invention.
Figure 2:
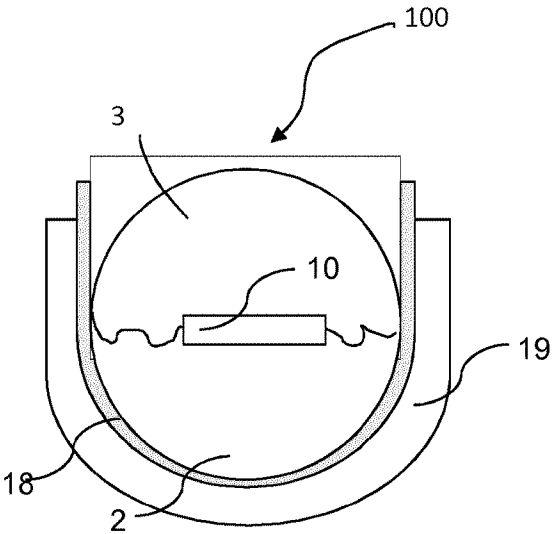
FIG. 2 is a front view in section of a detail of the apparatus of FIG. 1.
Figure 3:
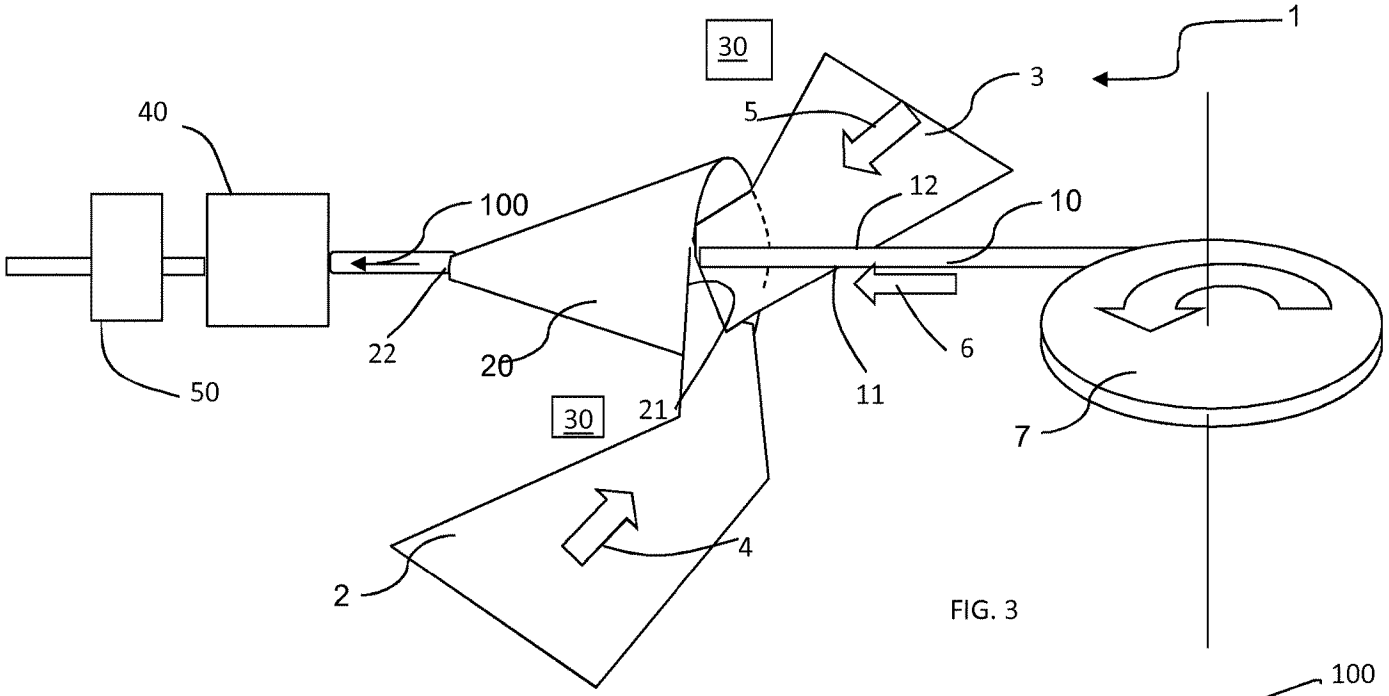
FIG. 3 is a schematic perspective view of a second embodiment of the apparatus of the invention.
Figure 4:
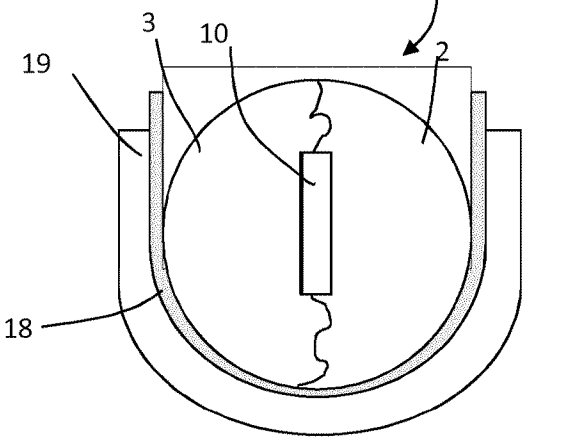
FIG. 4 is a front view in section of a detail of the apparatus of FIG. 2.

First the apparatus of FIGS. 1-3 is detailed.

The apparatus 1 is adapted to process a first and a second sheet of homogenized tobacco 2, 3 and a strip of susceptor material 10 in order to form a rod shaped article 100. The apparatus for this purpose includes suitable first and second movers 4, 5 (depicted schematically as arrows in the figures) to transport the first and second sheets 2, 3. The mover 4, 5 could be of any type, such as conveyor belts. Further, the apparatus also includes a third mover 6 (also depicted by an arrow) to transport the susceptor strip 10. The susceptor strip 10 may be wound in a bobbin 7, which is unwound while the rod component is formed.

The apparatus 1 further includes a rod forming device 20 having an inlet 21 and an outlet 22. The first, second and third movers 4, 5, 6 are directed towards the inlet 21 of the rod forming device 20. Each first, second and third mover defines a direction of transport of its respective first, second sheet 2, 3 or strip of susceptor material 10. Those first, second and third directions all point towards the inlet 21. The direction of transport of each sheet or strip is identified with the same arrow identifying the respective mover.

The first, second and third mover 4, 5, 6 are arranged in such a way that the strip of susceptor 10 is positioned between the two sheets of tobacco 2, 3. For example, in the embodiment of FIG. 1, the first and second sheets travel with their major surfaces directed upwards and also the strip of susceptor is travelling substantially horizontally.

Alternatively, as shown in FIG. 3, the sheets 2, 3 and the strip of susceptor 10 may travel substantially vertically.

The strip of susceptor 10 defines two opposite first and second surfaces 11, 12 which are planar. The first surface 11 faces the first sheet 2 and the second surface 12 faces the second sheet 3.

Upstream of the rod forming device 20, in the direction of motion of the first, second sheet, a crimper 30 may be present, preferably a crimper for each first and second sheet, in order to crimp the first and the second sheet before they enter into the rod forming device 20.

Further, downstream the rod forming device 20, preferably a wrapping unit 40 is positioned, to wrap the rod shaped article 100 exiting the outlet 22 of the rod forming device 20.

A cutting unit 50 may be present a well, downstream the wrapping unit 40, to cut the wrapped rod shaped article 100 in a plurality of components having the desired length to be used as part of an aerosol generating article.

The functioning of the apparatus of FIGS. 1, 2, 3 and 4 is as follows. The difference between the embodiment of the apparatus in FIGS. 1 and 3 lays only in the positioning of the sheets and susceptor strip. In the embodiment of FIG. 1, the susceptor strip 10 is substantially horizontal, while in the embodiment of FIG. 2, the susceptor strip is substantially vertical. The first and second sheet 2, 3, and the strip of susceptor 10, for example unwound from the bobbin 7, are introduced inside the rod forming device 20 via its inlet 21. After the rod forming, the resulting rod shaped article 100 is wrapped in wrapping paper 18 and moved by an U shaped convenyor belt 19. In case of the embodiment of FIG. 1, the resulting rod shaped article 100 is depicted in section in FIG. 2, where susceptor strip 10 is caught in between the two tobacco sheets 2, 3, and strongly held in a central horizontal position. The wrapping paper 18 is also visible. In the embodiment of FIG. 3, the resulting rod shaped article 100 is shown in section in FIG. 4, where the susceptor strip 10 is positioned vertically.

Figure 5:
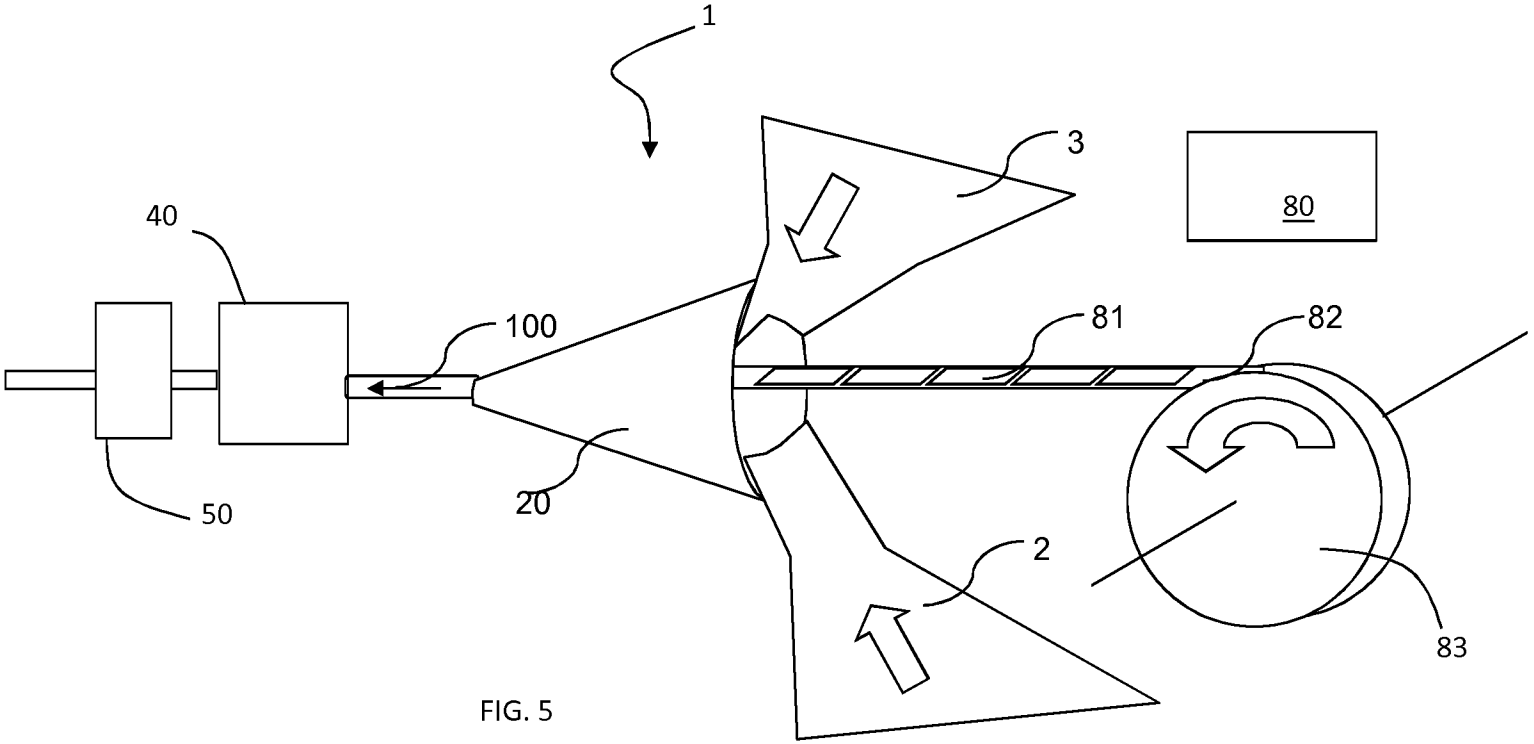
FIG. 5 is a schematic perspective view of a third embodiment of the apparatus of the invention.

In a different embodiment of the apparatus of the invention, depicted in FIG. 5, a susceptor cutting unit 80 is positioned upstream the rod forming device 20 to cut the susceptor strip into segments 81. The segments may be glued onto a third sheet of homogenized tobacco material 82, for example unwound from a bobbin 83, in series one after the other leaving a spacing between two adjacent segments. The so formed third sheet including the segments is positioned in the third mover 6 to be transported in the rod forming device 20. The remaining of the apparatus 1 is identical to those depicted with reference to FIGS. 1 and 3.

The sheets 2, 3 or 82, as well as the susceptor strip 10 or the susceptor segments 83, may be coated by a water solution, not depicted in the drawings.

The rod shaped article 100 is formed transporting the two sheets of tobacco material 2, 3 and the third sheet 82 having the segments 81 glued onto it into the inlet 21 of the rod forming device 20. The third sheet 82 is positioned as the susceptor strip 10 in the embodiment of FIG. 1 or 3, that is, it is sandwiched between the first and second strip 2, 3. The third sheet 82 and the first and second sheet 2, 3 can have any orientation, preferably horizontal as depicted, or also vertical.

Figure 6:
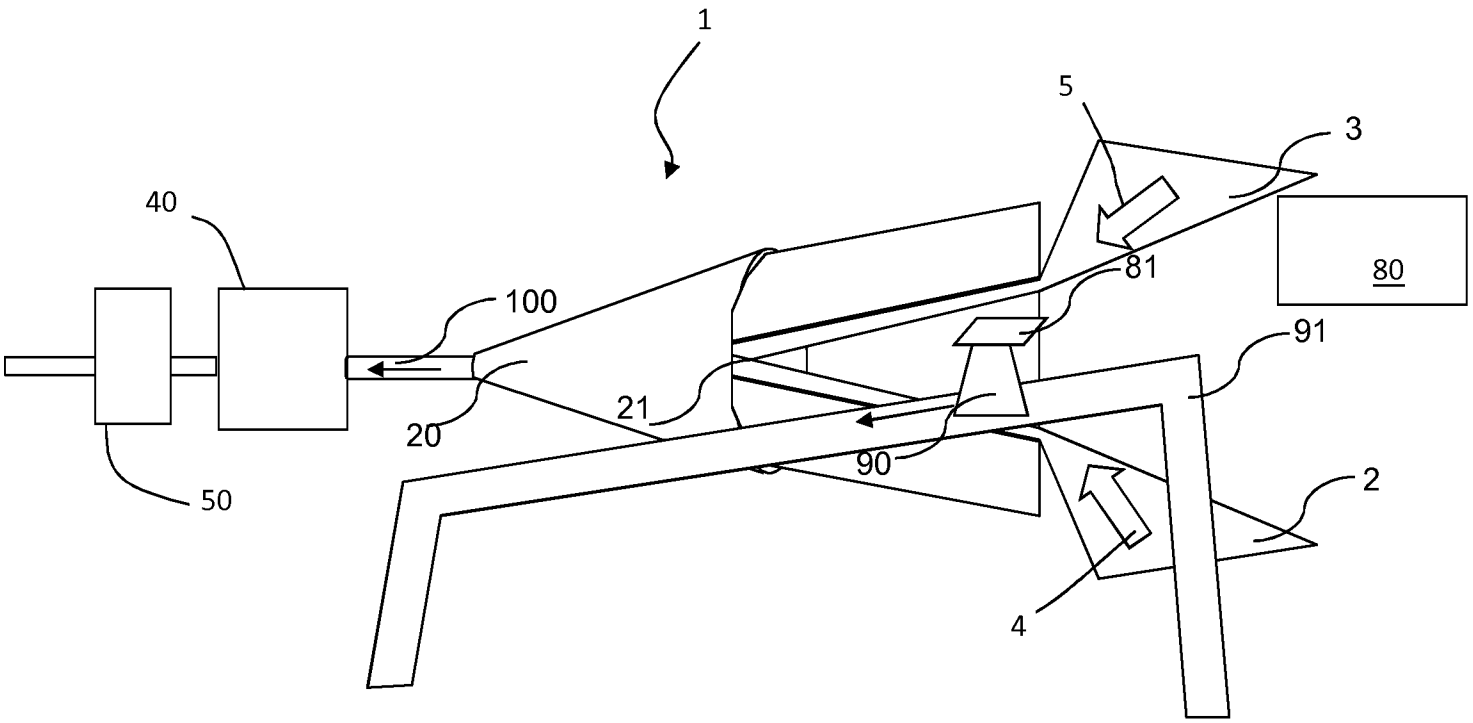
FIG. 6 is a schematic perspective view of a second embodiment of the apparatus of the invention.

In the embodiment depicted in FIG. 6, the apparatus 1 includes—as in the embodiment of FIG. 5—a susceptor cutting unit 80, however the segments 81 of susceptors are transported towards the rod forming device 20 by handlers 90, for example transported by a rail 91. The handlers 90 may keep the segments 81 attached thereto by magnetic action. The rod shaped article 100 is formed transporting the two sheets of tobacco material 2, 3 and the segments 81 into the inlet 21 of the rod forming device 20. The susceptor segments 81 are sandwiched between the first and second sheet 2, 3. The segments 81 and the first and second sheet 2, 3 can have any orientation, preferably horizontal as depicted, or also vertical.

In the embodiment of FIGS. 5 and 6, preferably the cutting unit 50 present downstream the rod forming device 20 is synchronized in its cutting speed with the speed of the transport of the susceptor segments 81, either glued on the third sheet 82 or transported by the handlers 90, so that the resulting rod shaped article 100 is cut in locations where no segment 81 is present.

The invention claimed is:

1. A method for the production of a component of an aerosol generating article, said method including:

providing a first sheet;

providing a second sheet;

providing a strip of susceptor;

transporting the first and second sheets and the strip of susceptor along a first, second and third direction, respectively, keeping the strip of susceptor located between the first and the second sheets during the transport; and forming a rod gathering together the first and the second sheets and the strip of susceptor located therebetween.

2. The method according to claim 1, wherein the step of moving the first sheet, the second sheet and the strip of susceptor along the first, second and third direction includes moving the first sheet, the second sheet and the strip of susceptor so that the first, second and third direction are coplanar.

3. The method according to claim 1, including:

coating the first or second sheet or the strip of susceptor with a water-based solution.

4. The method according to claim 1, wherein the step of providing the strip of susceptor includes:

providing a continuous strip of susceptor;

cutting the continuous strip of susceptor in susceptor segments; and transporting the susceptor segments between the first and second sheet.

5. The method according to claim 4, wherein the component of the aerosol generating article has a pre-determined length, and the step of cutting the continuous strip of susceptor in susceptor segments includes cutting the continuous strip of susceptor in susceptor segments having a length equal to or smaller than the pre-determined length of the component.

6. The method according to claim 3, including:

cutting the rod into components of the aerosol forming article.

7. The method according to claim 6, including:

synchronizing the cutting of the rod into components with a speed of the transport of the first sheet, or of the second sheet or of the strip of susceptor along the first, second or third direction, respectively.

8. The method according to claim 6 including:

sensing the presence of a susceptor segment in the rod before cutting the rod.

* * * * *